US009156142B2

(12) United States Patent
Hsieh

(10) Patent No.: US 9,156,142 B2
(45) Date of Patent: Oct. 13, 2015

(54) OPEN-END WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 45 days.

(21) Appl. No.: 13/952,673

(22) Filed: Jul. 29, 2013

(65) Prior Publication Data

US 2014/0283656 A1 Sep. 25, 2014

(30) Foreign Application Priority Data

Mar. 19, 2013 (TW) ..... 102109707 A

(51) Int. Cl.
*B25B 13/02* (2006.01)
*B25B 13/08* (2006.01)

(52) U.S. Cl.
CPC ..... *B25B 13/08* (2013.01)

(58) Field of Classification Search
CPC ..... B25B 13/08; B25B 13/48; B25B 13/46; B25B 13/02; B25B 13/481; B25B 13/00; B25B 23/00; B25B 7/02; B25G 1/102; B25G 1/105
USPC ..... 81/119, 125.1, 186, 58.2, 58, 52, 418, 81/424.5, 426
See application file for complete search history.

(56) References Cited

U.S. PATENT DOCUMENTS

| | | | | | |
|---|---|---|---|---|---|
| 1,261,565 | A * | 4/1918 | Leitner | ..... | 81/125.1 |
| 1,393,399 | A * | 10/1921 | Schlehr | ..... | 81/418 |
| 2,332,602 | A * | 10/1943 | Rosenbloom | ..... | 81/125.1 |
| 2,687,056 | A * | 8/1954 | Foor | ..... | 81/125.1 |
| 6,715,383 | B1 * | 4/2004 | Hsien | ..... | 81/119 |
| D519,009 | S * | 4/2006 | Hsieh | ..... | D8/28 |
| 7,066,057 | B2 * | 6/2006 | Hsien | ..... | 81/119 |
| D552,440 | S * | 10/2007 | Wu | ..... | D8/28 |
| 2005/0081686 | A1 * | 4/2005 | Hsien | ..... | 81/170 |
| 2006/0137494 | A1 * | 6/2006 | Wu | ..... | 81/119 |
| 2013/0042725 | A1 * | 2/2013 | Eggert et al. | ..... | 81/119 |

* cited by examiner

*Primary Examiner* — Monica Carter
*Assistant Examiner* — Melanie Alexander
(74) *Attorney, Agent, or Firm* — CKC & Partners Co., Ltd.

(57) ABSTRACT

An open-end wrench includes a handle and a driver. The driver is connected with an end of the handle for providing a torque for a work piece. The driver includes two jaw portions and at least one inclined plane. The two jaw portions are formed on two sides of a front side of the driver, and are spaced for forming an opening. The inclined plane is formed on the driver and inclines from a center of the driver to an edge of the driver, and inclines across one of the jaw portions, and inclines from a connecting portion between the handle and the driver to the front end of the driver.

6 Claims, 5 Drawing Sheets

OPEN-END WRENCH

RELATED APPLICATIONS

The application claims priority to Taiwan Application Serial Number 102109707, filed on Mar. 19, 2013, which is herein incorporated by reference.

BACKGROUND

1. Technical Field

The present disclosure relates to an open-end wrench, more particular relates to an open-end wrench with two different inclined plans on the driver thereof.

2. Description of Related Art

Open-end wrench is a widely used hand tool in daily life. An open-end wrench normally includes at least one driver connected with a handle. The driver includes two jaw portions, and an opening is formed between the two portions for providing a torque to a work piece. Therefore, the work piece can be tightened or loosened by rotating the open-end wrench.

The driver of the open-end wrench usually includes a contacting surface for engaging with a surface of a work piece in order to produce a torque center. In prior art, it is disclosed that an inclined plane being formed on the contacting surface. When the inclined plane contacts the work piece, an inclined angle is formed between the work piece and the open-end wrench, therefore, to provide a larger handling space and larger engaging force for driving the work piece. However, the inclined angle and position of the inclined plane is constrained, thus the contacting surface of the open-end wrench is too flat, leads to limited effects on increasing handling space and force.

Other prior arts disclose an inclined plane formed on different positions of the driver for increasing handling space and engaging force, however, the inclined angle and position of the inclined plane are not full considered, so that leads to limited effect.

SUMMARY

According to one aspect of the disclosure, an open-end wrench is provided. The open-end wrench includes a handle and a driver. The driver is connected with an end of the handle for providing a torque for a work piece. The driver includes two jaw portions and at least one inclined plane. The two jaw portions are formed on two sides of a front side of the driver, and are spaced for forming an opening. The inclined plane is formed on the driver and inclines from a center of the driver to an edge of the driver and inclines across one of the jaw portions, and inclines from a connecting portion between the handle and the driver to the front end of the driver. When the work piece is driven, a shifted-torque center is formed on a contacting surface between the inclined plane and the work piece.

According to another aspect of the disclosure, an open-end wrench is provided. The open-end wrench includes a handle and a driver. The driver is connected with an end of the handle for providing a torque for a work piece. The driver includes a first jaw portion a second jaw portion, a first inclined plane, and a second inclined plane. The first jaw portion is formed on a side of a front end of the driver. The second jaw portion is formed on the other side of the front end of the driver. The first jaw portion and the second jaw portion are spaced for forming an opening. The first inclined plane is formed on the driver, wherein the first inclined plane inclines with a first inclined angle from a center of the driver to an edge of the driver and inclines across the first jaw portion, and the first inclined plane inclines with a third inclined angle from a connecting portion between the handle and the driver to a front end of the first jaw portion. The second inclined plane is formed on the driver and is connected to the first inclined plane, wherein the second inclined plane inclines with a second inclined angle from a center of the driver to the other edge of the driver and inclines across the second jaw portion, and the second inclined plane inclines with a fourth inclined angle from the connecting portion between the handle and the driver to a float end of the second jaw portion. Wherein a first torque center is formed when the first inclined plane is contacted with the work piece, a second torque center is formed when the second inclined plane is contacted with the work piece, and the first torque center shifts to the second torque center during operation.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
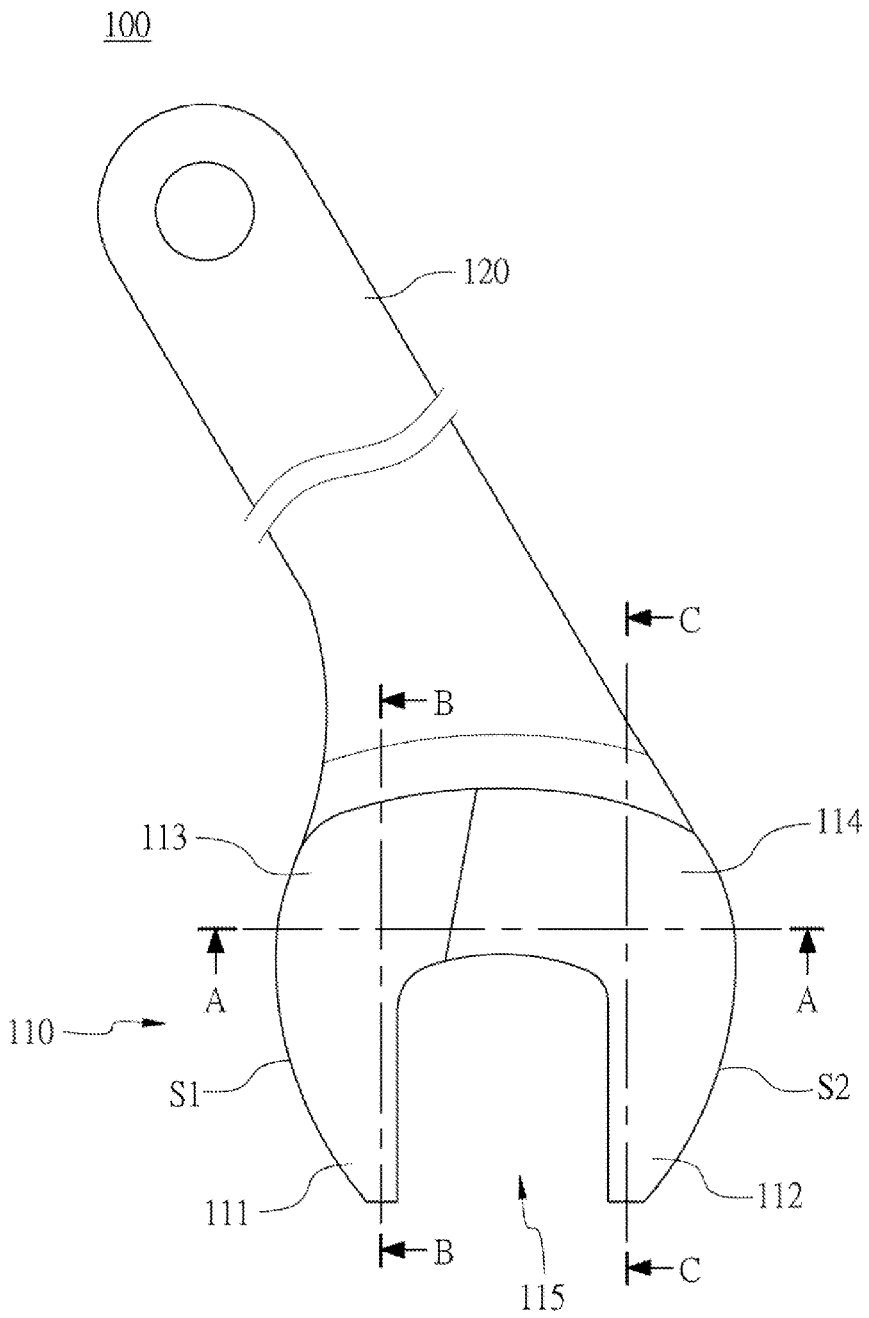
FIG. 1 is a top view of an open-end wrench according to one embodiment of the present disclosure.

FIG. 1 is a top view of an open-end wrench 100 according to one embodiment of the present disclosure. The open-end wrench 100 includes a driver 110 and a handle 120. The driver 110 is connected with an end of the handle 120. The driver 110 includes a first jaw portion 111, a second jaw portion 112, a first inclined plane 113 and a second inclined plane 114. The first jaw portion 111 and the second jaw portion 112 are formed on two sides of a front end of the driver 110 respectively, and an opening 115 is formed between the first jaw portion 111 and the second jaw portion 112 for engaging with a work piece. The first inclined plane 113 is formed on the driver 110 and inclines from a center of the driver 110 to an edge S1 of the driver 110. The second inclined plane 114 is formed on the driver 110 and is connected to the first inclined plane 113. The second inclined plane 114 inclines from a center of the driver 110 to the other edge S2 of the driver 110. Specifically, the inclined direction of the first inclined plane 113 and the inclined direction of the second inclined plane 114 are different.

Figure 2:
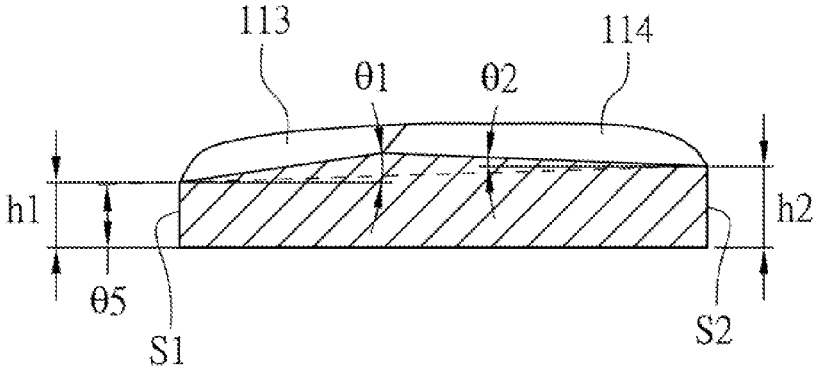
FIG. 2 is a cross-sectional view taken along line A-A of FIG. 1.

FIG. 2 is a cross-sectional view taken alone line A-A of FIG. 1. In FIG. 2, the first inclined plane 113 has a first inclined angle θ1, and the second inclined plane 114 has a second inclined angle θ2. The first inclined angle θ1 is ranged from 0.5 degrees to 30 degrees, and the second inclined angle θ2 is ranged from 0.5 degrees to 30 degrees. Therefore, the first and the second inclined angles (θ1、θ2) can be changed for increasing a handling space, and can be engaged with the work piece located on a non-uniform surface. Furthermore, two thicknesses h1, h2 of the two edges S1、S2 of the driver 110 can be different. For an example, h2 can be larger than h1, and a fifth inclined angle θ5 is formed. The fifth inclined angle θ5 is ranged from 0.5 degrees to 30 degrees, so that its favorable for adjusting the operating gesture and engaging with the work piece located on different surfaces for increasing smooth of operation.

Figure 3:
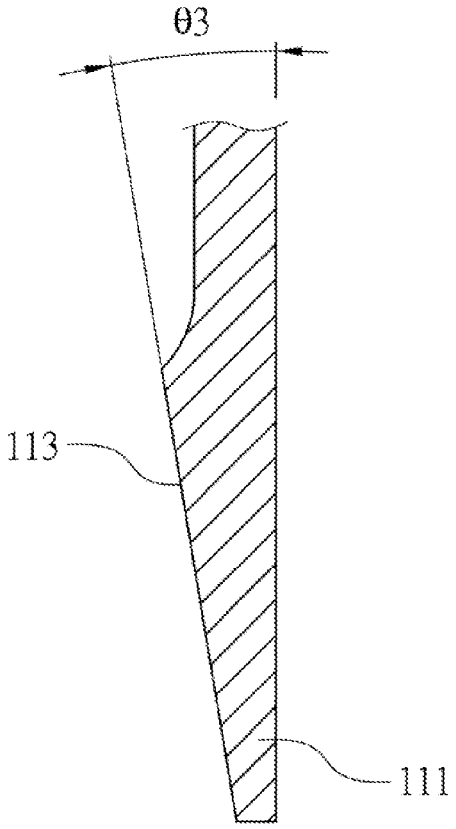
FIG. 3 is a cross-sectional view taken along line B-B of FIG. 1.

FIG. 3 is a cross-sectional view taken along line B-B of FIG. 1. In FIG. 3, the first inclined plane 113 inclines not only to the edge S1 of the driver 110 but to the front end of the first jaw portion 111. The first inclined plane 113 inclines to the front end of the first jaw portion 111 with a third inclined angle θ3. Therefore, the operating gesture can be adjusted for engaging with the work piece located on different surfaces and increasing smooth of operation by the third inclined angle θ3.

Figure 4:
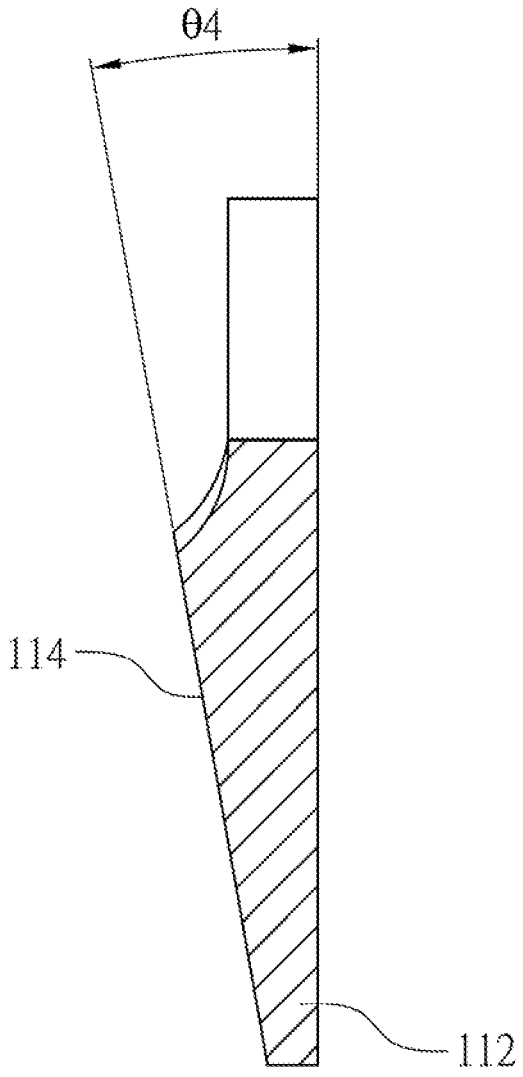
FIG. 4 is a cross-sectional view taken along line C-C of FIG. 1.

FIG. 4 is a cross-sectional view taken along line C-C of FIG. 1. In FIG. 4, the second inclined plane 114 inclines not only to the edge S2 of the driver 110 but to the front end of the second jaw portion 112. The second inclined plane 114 inclines to the front end of the second jaw portion 112 with a fourth inclined angle θ4. Therefore, the operating gesture can be adjusted for engaging with the work piece located on different surfaces and increasing smooth of operation by the fourth inclined angle θ4. The difference between the third inclined angle θ3 and the fourth inclined angle θ4 is 0.6 degrees, that is, mismatch between the open-end wrench 100 and the work piece can be reduced for increasing operating efficiency.

Figure 5:
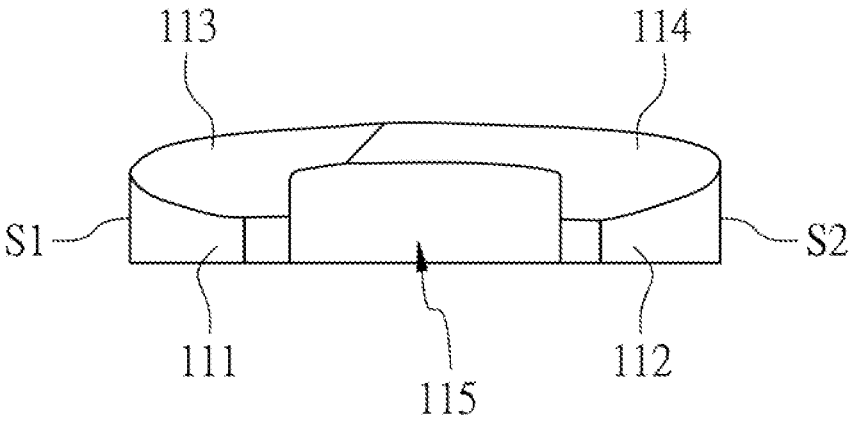
FIG. 5 is a front view of the open-end wrench of FIG. 1.

FIG. 5 is a front view of the open-end wrench 100 of FIG. 1. In FIG. 5, it is shown that how the first inclined plane 113 and the second inclined plane 114 formed on the driver 110. The first inclined plane 113 inclines to the edge S1 of the driver 110 and to the front end of the first jaw portion 111 simultaneously, and the second inclined plane 114 inclines to the edge S2 of the driver 110 and to the front end of the second jaw portion 112 simultaneously. The multiple inclined angles of the open-end wrench 100 are formed for engaging the work pieces on different surfaces, and the user can adjust operating gesture varied with different situations for increasing smooth of operation.

Figure 6A:
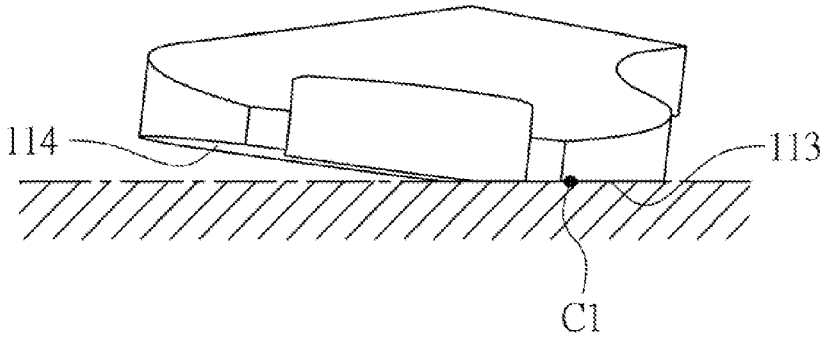
FIG. 6A shows a first tightening procedure of the open-end wrench of FIG. 1.
Figure 6B:
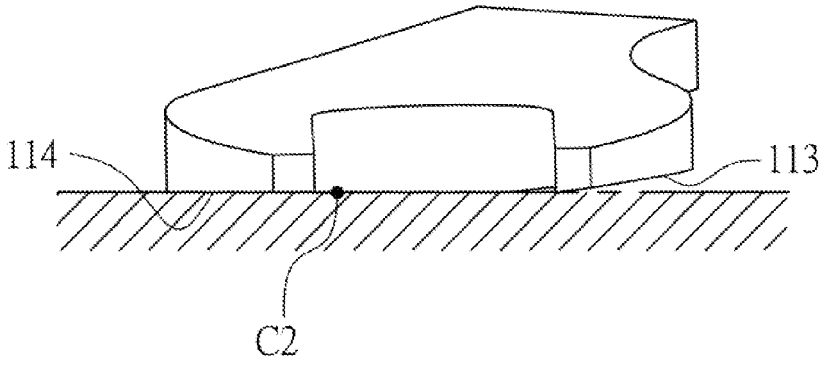
FIG. 6B shows a second tightening procedure of the open-end wrench of FIG. 1.

FIGS. 6A and 6B show a two-step tightening procedure of the open-end wrench 100 of FIG. 1. FIG. 6A shows a first tightening procedure of the open-end wrench 100 of FIG. 1 and FIG. 6B shows a second tightening procedure of the open-end wrench 100 of FIG. 1. Initially, when the driver 110 is engaged to a work piece, a first torque center C1 is formed between the first inclined plane 113 and the work piece. However, when the user keeps operating the open-end wrench 100, the holding gesture of a hand of the user will be gradually constrained. In FIGS. 6A and 6B, the first inclined plane 113 is connected to the second inclined plane 114, wherein the inclined angles and directions of the first inclined plane 113 are different from the inclined angles and directions of the second inclined plane 114. Therefore, when the user feels that the holding gesture of his hand has reached a limitation of physical dynamics, the user can change his holding gesture for rotating the open-end wrench 110 and make the second inclined plane 114 contact with the work piece, so that a second torque center C2 is formed. During above procedure, the configurations of the first inclined plane 113 and the second inclined plane 114 and the shift between the first torque center C1 and the second torque center C2 can reduce the limitation of the holding gesture and broaden the holding period during operation, thus can reduce operation times and the user can apply the force more uniformly. In this embodiment, a tightening procedure is demonstrated; the same effect can be applied to a loosening procedure.

To sum up, the open-end wrench 100 with different inclined planes (113, 114) on its driver 110 is disclosed. The second inclined plane 114 is connected to the first inclined plane 113, and the inclined direction and angles of the second inclined plane 114 and the first inclined plane 113 are different. Compared to the conventional open-end wrench, the open-end wrench 100 of the disclosure can increase the operation time at a single cycle, and can enhance the smooth of operation by changing the holding gesture due to a shift-torque center occurred when transforming form the first inclined plane 113 to the second inclined plane 114. Therefore, in the present disclosure, the two inclined planes (113, 114) with different inclined angles (θ1、θ2) and directions are formed on the driver 110 of the open-end wrench 100. The two different inclined planes (113, 114) can provide a shift-torque center when a user's operating gesture reach a limit of physical dynamics, thus the operating gesture can be modified for increasing smooth of operation and decreasing operation time.

What is claimed is:

1. An open-end wrench, comprising:

a handle; and a driver connected with an end of the handle for providing a torque for a work piece, the driver comprising:

a first jaw portion formed on a side of a front end of the driver;

a second jaw portion formed on the other side of the front end of the driver, wherein the first jaw portion and the second jaw portion are spaced for forming an opening;

a first inclined plane formed on the driver, wherein the first inclined plane inclines with a first inclined angle from a center of the driver to an side edge of the driver and inclines across the first jaw portion, and the first inclined plane inclines with a third inclined angle from a connecting portion between the handle and the driver to a front end of the first jaw portion; and a second inclined plane formed on the driver and connected to the first inclined plane, wherein the second inclined plane inclines with a second inclined angle from a center of the driver to the other side edge of the driver, an inclined direction of the first inclined plane and an inclined direction of the second inclined plane are different, and inclines across the second jaw portion, and the second inclined plane inclines with a fourth inclined angle from the connecting portion between the handle and the driver to a front end of the second jaw portion;

wherein the first inclined plan and the second inclined plan are formed in the same side of the driver, a first torque center is formed when the first inclined plane is contacted with the work piece, a second torque center is formed when the second inclined plane is contacted with the work piece, and the first torque center shifts to the second torque center during operation.

2. The open-end wrench of claim 1, wherein the first inclined angle is ranged from 0.5 degrees to 30 degrees.

3. The open-end wrench of claim 1, wherein the second inclined angle is ranged from 0.5 degrees to 30 degrees.

4. The open-end wrench of claim 1, wherein the third inclined angle is different from the fourth inclined angle.

5. The open-end wrench of claim 4, wherein a difference between the third inclined angle and the fourth inclined angle is 0.6 degrees.

6. The open-end wrench of claim 1, further comprising:

a fifth inclined angle formed from one edge of the driver to the other edge of the driver, and the fifth inclined angle is ranged from 0.5 degrees to 30 degrees.

* * * * *